US005166023A

United States Patent [19]

Harada et al.

[11] Patent Number: 5,166,023

[45] Date of Patent: Nov. 24, 1992

[54] ELECTROPHOTOGRAPHIC PHOTORECEPTOR AND RELATED METHOD

[75] Inventors: Yusuke Harada; Hidekazu Aonuma, both of Kanagawa, Japan

[73] Assignee: Fuji Xerox Corporation, Ltd., Tokyo, Japan

[21] Appl. No.: 529,367

[22] Filed: May 29, 1990

[30] Foreign Application Priority Data

May 30, 1989 [JP] Japan ..... 1-134752

[51] Int. Cl.[5] ..... G03G 5/10

[52] U.S. Cl. ..... 430/62; 430/69

[58] Field of Search ..... 430/65, 62, 63, 69

[56] References Cited

U.S. PATENT DOCUMENTS

| | | | |
|---|---|---|---|
| 4,134,763 | 1/1979 | Fujimura et al. | 430/127 |
| 4,314,763 | 2/1982 | Steigmeier et al. | 356/237 |
| 4,514,483 | 4/1985 | Matsuura et al. | 430/84 |
| 4,654,285 | 3/1987 | Nishiguchi | 430/69 |
| 4,696,884 | 9/1987 | Saitoh et al. | 430/133 |

FOREIGN PATENT DOCUMENTS

| | | |
|---|---|---|
| 200468 | 11/1986 | European Pat. Off. . |
| 58-17105 | 2/1983 | Japan . |
| 58-82249 | 5/1983 | Japan . |
| 58-162975 | 9/1983 | Japan . |
| 59-158 | 1/1984 | Japan . |
| 59-204048 | 11/1984 | Japan . |
| 60-79360 | 5/1985 | Japan . |
| 60-86550 | 5/1985 | Japan . |
| 60-112049 | 6/1985 | Japan . |
| 61-42663 | 3/1986 | Japan . |
| 62-150259 | 7/1987 | Japan . |
| 62-186270 | 8/1987 | Japan . |

OTHER PUBLICATIONS

Schaffert R. M., "A New High-Sensitivity Organic Photoconductor For Electrophotography", IBM Journal Of the Research And Development, pp. 75-89, Jan. 1971.

*Primary Examiner*—John Goodrow

*Attorney, Agent, or Firm*—Finnegan, Henderson, Farabow, Garrett and Dunner

[57] ABSTRACT

An electrophotographic photoreceptor has a photosensitive layer layered on a conductive substrate, and the photoreceptor comprise the improvement wherein a surface roughness of the conductive substrate is such that a center average roughness in standard length at 0.25 mm is not more than 0.6, and the center average roughness and a transmittance at a wavelength of light to which the photosensitive layer is exposed meet the following condition.

$$\frac{T-3}{38} \leqq Ra \leqq \frac{T+12}{55}$$

5 Claims, 1 Drawing Sheet

ELECTROPHOTOGRAPHIC PHOTORECEPTOR AND RELATED METHOD

BACKGROUND OF THE INVENTION

The present invention relates to an electrophotographic photoreceptor and an image forming method using the same, and more particularly for the electrophotographic photoreceptor well adaptable for an electrophotographic printer in which the line scan by a laser beam is used for image formation, and an image forming method using such an electrophotographic photoreceptor.

In an electrophotographic printer of the type in which the line scan is carried out by using a laser beam, a gas laser of a relatively short wavelength, such as a helium-cadmium laser, argon laser, and helium-neon laser, is used for generating the laser beam. An electrophotographic photoreceptor, which is used in combination with the gas laser, uses a CdS-binder photosensitive layer and a charge transfer complex (IBM Journal of the Research and Development, Jan. 1971, pp. 75 to 89), which corporate to form a thick photosensitive layer. With such a structure, there occurs no multiple reflection of the laser beam within the photosensitive layer. An image as formed is free from a pattern of interference fringes.

Recently, a semiconductor laser has gradually superseded the gas laser, because of recent design trend of reducing cost and size of the electrophotographic printer. The semiconductor laser generally requires the electrophotographic photoreceptor whose sensitivity is high in a region of long wavelengths. The electrophotographic photoreceptor has also been developed so as to have such a sensitivity characteristic.

For the photosensitive members with good sensitivity for radiation of long wavelengths for example, not more than 600 nm, which have been known, there may be enumerated the electrophotographic photoreceptor using the photosensitive layer containing phthalocyanine pigment, such as copper phthalocyanine, aluminum chloride phthalocyanine, particularly the electrophotographic photoreceptor of the multi-layer type including a multi-layer photosensitive layer consisting of a charge generating sub-layer and a charge transfer sub-layer, and the electrophotographic photoreceptor using a selen-tellurium film.

Let us consider a case that the electrophotographic photoreceptor of such a photosensitive characteristic is coupled with the electrophotographic printer of the laser beam scan type, and a laser beam exposure is applied thereby to form a toner image. In this case, an interference fringe pattern appears in the toner image. The resultant reproduced image is poor.

One of the causes to produce the interference fringes follows. The laser beam of long wavelength is incompletely absorbed within the photosensitive layer, part of the laser beam is transmitted through the photosensitive layer, and is reflected on the substrate surface. Accordingly, a multiple reflection of the laser beam is caused within the photosensitive layer. The multiple reflected laser beam interferes with light reflected on the surface of the photosensitive layer.

There have been proposals to solve the multiple reflection within the photosensitive layer. A first proposal is to rough the surface of the conductive substrate in an electrophotographic photoreceptor layer by anodic oxidation treatment or buffing, as disclosed in Japanese Patent Unexamined Publication Nos. Sho. 58-162975, Sho. 60-79360, Sho. 60-112049, Sho. 61-42663, and Sho. 62-186270. A second proposal is to interlayer a light absorbing layer or a reflection preventive layer between the photosensitive layer and the substrate, such as disclosed in Japanese Patent Unexamined Publication Nos. Sho. 58-17105, Sho. 59-158, Sho. 59-204048, Sho. 60-86550, and Sho. 62-150259. A third proposal is disclosed in Japanese Patent Unexamined Publication No. Sho. 58-82249 in which most of light from a light source is absorbed by the charge generating layer. A fourth proposal is to quench the multiple reflection by using the substrate as subjected to colored anodized aluminum.

Actually, however, the proposals as mentioned above fail to completely remove the interference fringes produced at the time of forming an image. Particularly, in the first proposal to make the substrate surface irregular, it is difficult to uniformly rough the substrate surface. Accordingly, a relatively thin irregularity is present in a local area, which occupies a specific ratio of the substrate surface. In this case, the thin irregularity area serves as a carrier injection part for the photosensitive layer. This causes white spots at the time of image formation (in the reversal development method, black spots appear in the image). In this point, the first proposal is disadvantageous. For only the interference fringes problem, there are many solutions. For both the problems of the interference fringes and of the white spots or black spots, it is very difficult to find good solutions. In the proposal to rough the surface of the conductive substrate, difficulty exists in manufacturing a lot of the substrates whose surfaces have uniform irregularity. Thus, the first proposal involves problems to be solved.

In the case of the second proposal using the underlayer with a diffuse reflection surface between the conductive substrate and the photosensitive layer, it is difficult to intentionally control the irregularities on the irregular surface of the underlayer, and further to reproduce the same irregular surface. To rough the surface of the underlayer to such an extent as to effectively prevent the interference fringes, a large thickness is required for the underlayer. The thick underlayer adversely affects the electrophotographic characteristics, such as a sensitivity of the photosensitive layer, adhesiveness, and the like. Use of the underlayer that makes the structure of the electrophotographic photoreceptor complicated leads to increase of the cost to manufacture.

The proposal to absorb most of light from a light source by using the charge generating layer may be realized by (1) increasing the thickness of the charge generating layer, (2) making the peak of the spectral absorption of the charge generating layer approximate to the wavelength of the light source light, or (3) using pigment to absorb the light source light. In the case of (1) above, if the charge generating layer is made thick to completely remove the interference fringes, it is unsuitable for the electrophotographic operation. Specifically, the thermally excited carriers are increased, and adversely affects the dark attenuation and the acceptance potential. In the case of (2) above, it is difficult to find materials having such a nature. If found, few materials have satisfactory performances, and it is difficult to effectively use the materials. If the absorption peak of the material overlaps with the wavelength of the light source light, the material has a limit in its absorption. In the case of (3), there is the possibility that use of the pigment has an adverse effect on the electrophotographic characteristics. Further, few pigments having no adverse effect exist.

Let us consider the proposal using a light absorbing layer between the conductive substrate and the photosensitive layer. In this proposal, as of the selenium photosensitive member disclosed in Japanese Patent Unexamined Publication No. Sho. 62-150259, the light absorbing layer for absorbing light of a specific wavelength must be additionally layered on the substrate which is polished and subjected to etching process. The additional use of the absorbing layer makes the layer structure complicated and increases cost to manufacture.

The proposal using the conductive substrate as subjected to colored anodized aluminum is allowed to be applied for only the substrate that is made of metal. To prevent the generation of the interference fringes pattern, it is necessary to use a thick anodic aluminum. Use of the thick anode aluminum deteriorates conductivity and hence, the electrophotographic characteristic of the electrophotographic photoreceptor.

SUMMARY OF THE INVENTION

With the view of overcoming the problems as mentioned above, the present invention has been proposed.

Accordingly, an object of the present invention is to solve foregoing problems and provide an electrophotographic photoreceptor.

Another object of the present invention is to provide an electrophotographic photoreceptor for a laser printer which requires no underlayer with a diffuse reflection surface, and succeeds in completely removing the interference fringes pattern and the white or black spots as well that are caused at the time of image formation, without any adverse effect on the electrophotographic characteristics.

A yet another object of the present invention is to provide an image forming method using the electrophotographic photoreceptor.

To achieve the above objects, there is provided an electrophotographic photoreceptor having a photosensitive layer layered on a conductive substrate, in which the surface of the conductive substrate has a surface roughness as defined by Ra (center average roughness) $\leqq 0.6$ μm for a reference length of 0.25 mm, and the Ra and a transmittance T at a wavelength of light to which a photosensitive layer is exposed, are given by the following inequality (1).

$$\frac{T-3}{38} \leqq Ra \leqq \frac{T+12}{55} \quad (1)$$

According to another aspect of the invention, there is provided an image forming method wherein a photosensitive layer of an electrophotographic photoreceptor, which is defined by the inequality (1) and in which the photosensitive layer is layered on a conductive substrate, is uniformly charged, an electrostatic latent image is formed on the photosensitive layer by exposing the photosensitive layer to a laser beam, and the latent image is developed.

The center average roughness Ra is ruled by JIS B0601, and measured by, for example, a surface roughness meter made by Lehler hopson co. or a versatile surface tester by KOSAKA laboratory. The transmittance T at a wavelength of light used for exposing the photosensitive layer is measured in a manner and that the photosensitive layer is layered on a polyethylene terephthalate film, and a recording spectrophotometer 330 made by HITACHI manufacturing company, for example, is used.

The center average roughness Ra and the transmittance T must satisfy the above inequality. If those factors are related by $(T-3)/38 > Ra$, it is impossible to prevent the generation of the interference fringe pattern. If $(T+12)/55 < Ra$, and Ra exceeds 0.6 μm, the number of white spots (black spots for the reversal development method) increases, and the resultant copy image is poor in image quality.

The preferable center average roughness Ra is within a range between 0.10 μm and 0.45 μm.

The preferable transmittance T is not more than 18%. To reduce the transmittance T to a preset value, the photosensitive layer, particularly the charge generating layer, and cost are taken into consideration.

The electrophotographic photoreceptor according to the present invention is well adaptable for an image forming method using a laser beam as a light source. An oscillating frequency of the laser beam is preferably within a range between 630 nm and 830 nm.

The electrophotographic photoreceptor according to the present invention may be the electrophotographic photoreceptor having a photosensitive layer of a called single layer type or the electrophotographic photoreceptor having the photosensitive layer of the multi-layer type consisting of the charge generating layer and the charge transfer layer.

DETAILED DESCRIPTION OF THE PREFERRED EMBODIMENTS

Figure 3:
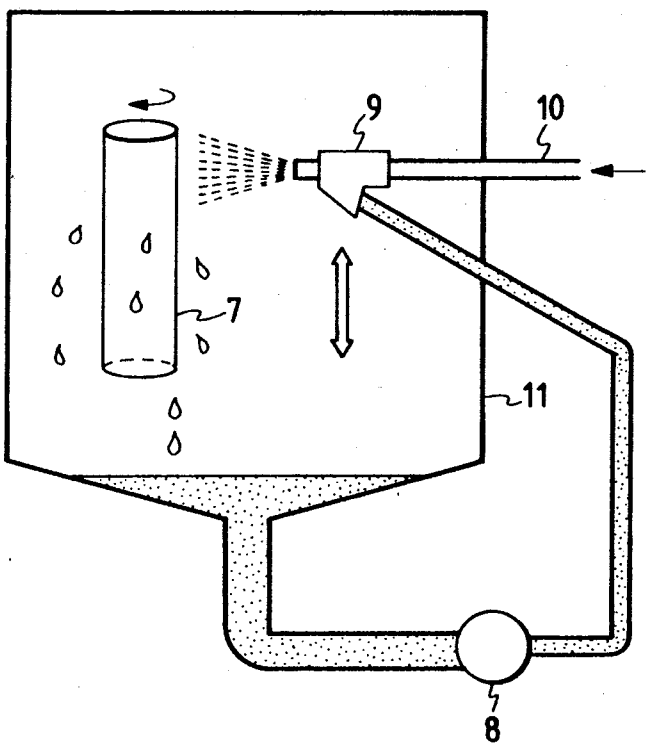
FIG. 3 shows a schematic illustration of a wet honing apparatus use for manufacturing the electrophotographic photoreceptor according to the present invention.

Referring to the drawings, preferred embodiments of the present invention will now be described.

An operation of the invention will now be described using an electrophotographic photoreceptor of the multi-layer type.

In the layer structure of the electrophotographic photoreceptor of the multi-layer type, the interference fringes pattern appearing at the time of electrophotographically forming an image by a laser beam is generated through such a mechanism that an interference among the Fresnel reflection components occurs at the interface between the adjacent layers in the photosensitive layer due to a reflectivity difference between the adjacent ones, and the interference changes the amount of incident light.

Figure 1:
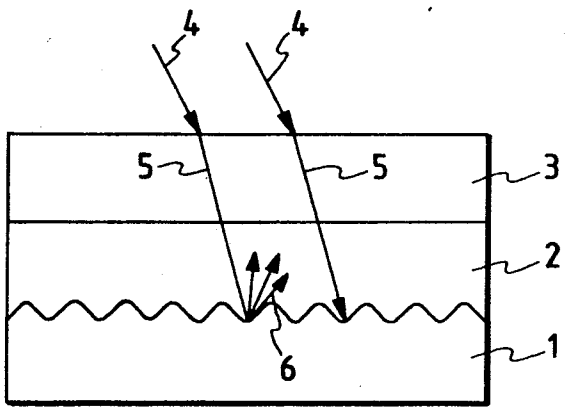
FIG. 1 is a diagram useful in explaining optical paths in an electrophotographic photoreceptor according to the present invention.
Figure 2:
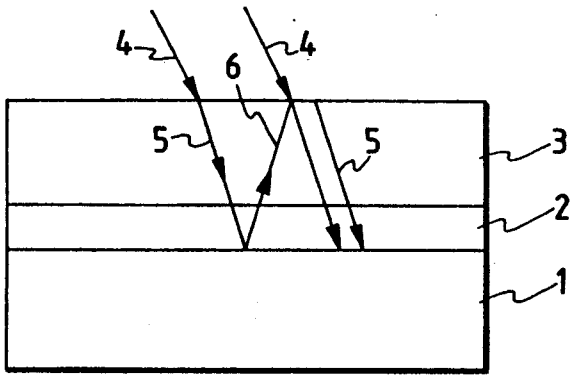
FIG. 2 is a diagram useful in explaining optical paths in a conventional electrophotographic photoreceptor or member.

FIGS. 1 and 2 are explanatory diagrams showing optical paths of light entering the electrophotographic photoreceptor. FIG. 1 illustrates optical paths for the electrophotographic photoreceptor according to the present invention. FIG. 2 illustrates optical paths for a conventional electrophotographic photoreceptor. As shown in FIG. 2, in the conventional electrophotographic photoreceptor of the multi-layer type, which consists of a conductive substrate 1, a charge generating layer 2, and a charge transfer layer 3, after a laser beam 4 enters the photosensitive layer in the form of an incident light beam 5, a reflecting light beam 6 reflected at the interfaces between the photosensitive layer and the substrate and between the photosensitive layer and air, interferes with the incident light beam 5 to form interference fringes, since a phase difference exists between the reflecting light beam 6 and the incident light beam. In the electrophotographic photoreceptor according to the present invention, as shown in FIG. 1, the incident light beam 5 as the laser beam 4 is incident on an irregular surface of the substrate 1, and its optical path is changed thereon. An optical path of the reflecting light beam 6 reflected at the interfaces between the photosensitive layer and the substrate 1 and between the photosensitive layer and air, is also changed. The optical paths of the incident light beam 5 and the reflecting light beam 6 are different from each other. An amount of the reflecting light from the substrate, which greatly contributes to the generation of the interference fringes, is reduced because it is absorbed by the photosensitive layer. As a consequence, no interference fringes is generated.

As described above, in the present invention, the surface of the substrate is roughed to have a light diffuse property. The absorption of incident light by the photosensitive layer is utilized. In this case, the roughness of the substrate surface and the transmittance of the photosensitive layer are defined by the above inequality. With such a technical idea, the present invention successfully eliminates the generation of the interference fringes.

An electrophotographic photoreceptor according to the present invention will be described.

In the present invention, the conductive substrate may be a drum or sheet made of metal, such as aluminum, copper, iron, zinc, and nickel.

In the present invention, the surface of the substrate is roughed. Any of the following methods may be used for roughing the substrate surface: method to adjust an accuracy of surface cutting, method to press contact a rotating grinder with the substrate surface, anodic oxidation treatment, etching process, method using sand paper, wet honing process, method by sand blast, and buffing. Of those methods, the wet honing process is preferable because a short process time is required, the work required is simple, a desired roughness can readily be obtained, and a good stability is obtained.

In the wet honing process, powder of abrasive is suspended into a liquid, such as water. The substrate surface is blasted with the liquid containing the abrasive. In this way, the substrate surface is made uniformly rough. A roughness on the substrate surface can be controlled by blasting pressure, blasting speed, amount, kind, shape, size, hardness, and specific gravity Of abrasive, suspension temperature, and the like.

In the present invention, the conductive substrate must be roughed so as to have a surface roughness of it, i.e., a center average roughness Ra for a reference length of 0.25 mm, as defined by the inequality (1) in connection with the transmittance T at a wavelength of exposing light for the photosensitive layer.

If required, an underlayer is formed on the roughed surface of the conductive substrate. The underlayer is made of known synthetic resin. The thickness of the underlayer is 0.05 to 10 μm, preferably 0.1 to 2 μm.

The photosensitive layer may have either a single layer structure or a multi-layer structure. In the case of the multi-layer structure, either the charge generating layer or the charge transfer layer may be the conductive substrate.

For the photosensitive layer of the single layer structure, the following layers may be enumerated; a ZnO photosensitive layer as pigment sensitized, CdS layer, and a photosensitive layer in which the charge generating material is diffused into the charge transfer material. In the case of the multi-layer structure of the function separated type, the charge generating layer is made of the charge generating material or formed by diffusing the charge generating material into integrity resin.

The charge generating material may be any of known materials, such as azo dye including chlorodion blue, chinone dye including anthoantron, perilliene chinone, and the like, chinone cyanine dye, perylene pigment, perynon pigment, indigo dye, bisbenzoimidazole pigment, phthalocyanine pigment including copper phthalocyanine, vanadyl phthalocyanine, azulene chloride, squarylium pigment, and quinacridone pigment.

The integrity resin may be any of known resin, such as polystyrene resin, polyvinyl acetal resin, acrylate resin, methaacrylate resin, vinyl acetate resin, polyester resin, polyarylate resin, polycarbonate resin, and phenol resin.

The charge generating layer is formed in a manner such that the charge generating material as mentioned above is mixed into the solution of the integrity resin, and the substrate surface is coated with the solution containing the charge generating material. The solution of the integrity resin may be any of ordinarily used organic solvent, such as methanol, ethanol, n-propanol, n-butanol, benzyl alcohol, methyl-cellosolve, ethyl-cellosolve, acetone, methyl ethyl ketone, cyclohexanone, methyl acetate, dioxane, tetrahydronfuran, methylenechloride, and chloroform. The thickness of the charge generating layer is generally within a range of 0.1 to 5 μm, preferably 0.2 to 2.0 μm.

The charge transfer layer is made of an integrity resin into which charge transfer material is diffused. The charge transfer material may be any of polycyclic aromatic series such as anthracene, pyrene, and phenanthrene, nitrogen containing heterocyclic compound such as indole, carbazole, and imidazole, pyrazoline compound, hydrazone compound, triphenylmethane compound, triphenyl amine compound, enamine compound, stilbene compound, and the like.

The integrity resin may be any type resin if it has a film forming property, such as polyester, polysulfone, o polycarbonate, and polymethylmethacrylate.

The charge transfer layer is formed in a manner that the integrity resin is dissolved into a solvent, and the surfaces of the charge generating layer is coated with the solution thus prepared. The solvent used may be any of ordinarily used organic solvents, such as aromatic series hydrocarbon including benzene, toluene, xylene, and the like, ketone group including acetone, and 2-butanone, halogenated carbon hydride including methylene chloride, monochlorobenzene, chloroform, and the like, tetrahydrofuran, ethylether, and the like.

The thickness of the charge transfer layer is generally within 5 to 50 μm.

For forming an image by using the electrophotographic photoreceptor, the photosensitive layer is uniformly charged, exposed to a laser beam as an exposing means to form an image thereon, and is developed by an ordinary developing process.

The electrophotographic photoreceptor is applicable for an image forming method using a called reversal development method. In the reversal development method, the surface of the electrophotographic photoreceptor is uniformly charged in negative polarity, for example, and then is subjected to an exposing process, thereby to form an electrostatic latent image. Negatively charged tone is attached to a low potential portion (exposed portion) of the latent image, thereby to form a toner image. A transfer member is superposed on the photosensitive member holding the toner image thus formed. Positive charge is applied to the rear side of the transfer member, to transfer the toner image onto the transfer member.

An image forming method to which the electrophotographic photoreceptor is applied follows. The means for uniformly charging the surface of the photosensitive member may be any of a corona discharger, such as corotron, scorotron, diecorotron, and picorotron, charge roller, and the like. A preferable initial charge potential is within −700 V to −200 V.

The image exposing means is preferably a laser exposing optical system including a laser polarizer and a laser source, such as a semiconductor laser, He - Ne laser, and YAG 2nd-harmonic wave. A preferable wavelength of the laser beam is within 630 nm to 830 nm.

The electrostatic latent image formed through the exposing process is developed by developing material to form a toner image. The developing material may be either two-component developing material containing carrier and toner or one-component developing material containing only toner. Toner particle may be magnetic toner containing magnetic powder or nonmagnetic toner. In developing the latent image, a developing material holder holding the developing material is used, and toner particles are placed close to the latent image or made contact to the latent image so that the toner is selectively attached onto the latent image in accordance with potentials of the latent image.

In this case, in accordance with the charge polarity of the toner, the toner is attracted to the low potential portion (exposed portion) of the latent image on the photosensitive member (reversal development) or to the high potential portion (unexposed portion) (positive development). The positive or negative development depends on the charge polarity of the toner.

At the time of the development, a bias voltage may be applied to between the substrate of the electrophotographic photoreceptor and the developing material holder. The bias voltage may be a DC voltage or an AC voltage superposed with a DC voltage. Particularly in the reversal development, the bias voltage must be equal to or lower than the potential at the unexposed portion.

The toner image formed through the development may be transferred onto the transfer member by a suitable method. For the transfer means, a transfer roll applied with a transfer voltage, a pressure contact roll, and the like may be used in addition to the above corona charger. Particularly, an electric field transfer process is preferable, in which charge is applied to the rear side of the transfer member by using the corona charger. In the case of the toner particles negatively charged through the reversal development, the toner may be well transferred onto the transfer member by applying positive corona discharge to the rear side of the transfer member.

EXAMPLE

An electrophotographic photoreceptor and an image forming method using the photosensitive member will be described by way of example.

EXAMPLE 1

An aluminum pipe of 1 mm (thick)×40 mmϕ×310 mm was cut by a mirror-face lathe with a diamond cutting tool, and its surface was smoothed to have the center average roughness Ra of 0.04 μm. The aluminum pipe was placed in a liquid honing apparatus shown in FIG. 3, and subjected to a roughing process. In FIG. 3, reference numeral 7 designates a conductive substrate; 8 a pump; 9 gun; 10 an air guide pipe; 11 a process chamber. For the liquid honing process, abrasive of 10 kg (see Table 1) was suspended in water of 40. The abrasive contained water was fed at 6 l/min. to the gun 9 by the pump 6. The aluminum pipe was sprayed with that water from the gun at a spraying rate (see Table 1) and at a preset pressure of compressed air. At this time, the gun was moved vertically in the axial direction of the aluminum pipe at the rate of 40 cm/min., while the pipe was turned at 100 rpm.

In the example and other comparative examples, the surface roughness of the substrate, or the aluminum pipe, was controlled to be a predetermined roughness by varying a spraying rate through the control of the compressed air pressure, and varying a particle diameter of the abrasive: The substrates of different surface roughnesses were formed.

The aluminum pipe as subjected to the wet honing process was coated with methanol/butanol solution of copolymer nylon resin (CM8000, manufactured by TORE company) by using a ring coating machine, thereby to form an underlayer of 0.7 μm thick as a barrier layer.

3 parts by weight of vanadyl phthalocyanine were dispersed into 70 parts by weight of 10% cyclohexanone solution of polyester resin (PE 100, manufactured by Good-Year Chemical company). For the dispersion, the mixture was mixed for two hours by a ball mill using a ball of 10 mmϕ. 10 parts by weight of 2-butanone were added to the mixture, to form coating liquid. The barrier layer was with the coating liquid by the ring coating machine, thereby to form a charge generating layer of a predetermined thickness.

A charge transfer layer was formed on the charge generating layer thus formed. Specifically, 4 parts by weight of N,N,-diphenyl-N,N,-bis(3-methylphenyl)-[1,1,-biphenyl]-4,4,-diamine as charge transfer material, together with 6 parts by weight of polycarbonate resin (bisphenol Z type) were dissolved into 40 parts by weight of monochlorobenzene. The solution was set in a dipping/coating machine, and was applied to the charge generating layer at 11 cm/min. of the pull-up speed. Then, the resultant structure was dried for one hour at 110° C., thereby to form a charge generating layer of 20 μm thick.

The electrophotographic photoreceptor thus formed was set to a laser beam printer (LBP) with dot density of 400 dpi. An output image of the LBP was checked. No image defects, such as interference fringes, white spots, and black spots were found. An output test of 2000 copies was conducted. No image defects were found again.

The comparative examples showed the following results. In a comparative example 1, an unsatisfactory surface roughness was obtained and the interference fringes appeared in the output image. In a comparative example 2, no interference fringes appeared, but a number of black spots appeared in the white portion of the image. In a comparative example 3, the interference fringes pattern was found in the output image. In a comparative example 4, no interference fringe appeared, but a small number of black spots appeared. In a comparative example 5, the interference fringe appeared. In a comparative examples 6 and 7, no interference fringe was observed, but other image defects such as black spots and smear were observed.

TABLE 1

| | Scattering Effect | | Absorption Effect | | Image Defects of LBP (400 spi) | |
|---|---|---|---|---|---|---|
| | Surface Roughness Ra [μm] | Liquid Honing Condition Blast Rate [m/sec] | Transmittance T [%] | Charge Generating Layer Thickness [μm] | Interference Fringe | White or Black Spots |
| Example 1 | 0.15 | 60 | 8.3 | 0.2 | ○ | ○ |
| Example 2 | 0.35* | 70 | 8.3 | 0.2 | ○ | ○ |
| Example 3 | 0.10 | 40 | 5.9 | 0.27 | ○ | ○ |
| Example 4 | 0.30* | 60 | 5.9 | 0.27 | ○ | ○ |
| Example 5 | 0.44** | 68 | 13.5 | 0.10 | ○ | ○ |
| Example 6 | 0.30* | 60 | 13.5 | 0.10 | ○ | ○ |
| Comparative Example 1 | 0.12 | 50 | 8.3 | 0.2 | x | ○ |
| Comparative Example 2 | 0.40* | 65 | 8.3 | 0.2 | ○ | x |
| Comparative Example 3 | 0.06 | 20 | 5.9 | 0.27 | x | ○ |
| Comparative Example 4 | 0.33* | 65 | 5.9 | 0.27 | ○ | Δ |
| Comparative Example 5 | 0.25 | 78 | 13.5 | 0.10 | x | ○ |
| Comparative Example 6 | 0.47** | 72 | 13.5 | 0.10 | ○ | x |
| Comparative Example 7 | 0.52** | 78 | 17.0 | 0.36 | ○ | x |

*Alundum #320 is used.
**Alundum #280 is used.
Non mark: Alundum #400 is used.

As described above, in the present invention, a light absorption by a photosensitive layer of an electrophotographic photoreceptor and a light scattering by a roughed surface of a conductive substrate are related by the inequality as mentioned above. Accordingly, the surface roughness of the substrate, which is smaller than that in the conventional electrophotographic photoreceptor, suffices. The uniform surface roughness can readily be formed. Further, there is no need for excessive absorption of incident light by the photosensitive layer. Consequently, the electrophotographic photoreceptor according to the present invention is free from the problem of white spots or black spots (in the case of the reversal development) at the time of image formation, which is essential to the rough surface of the substrate, and the increase of the thermal carriers caused when the charge generating layer is made thick to increase light absorption. The electrophotographic photoreceptor according to the present invention has no adverse effects on the electrophotographic characteristics.

Where such an electrophotographic photoreceptor is used and an image is formed by a laser beam by a semiconductor laser, for example, the resultant image is free from the image defects, such as interference fringes, and white or black spots. Further, the dark attenuation is small, the electrostatic retentiveness is large, and the electric characteristic is stable. Accordingly, the electrophotographic photoreceptor according to the present invention is well adapted for an electrophotographic laser printer using a laser beam, particularly an electrophotographic printer of the type in which the line scan by a laser beam is used for image forming.

What is claimed is:

1. An electrophotographic photoreceptor comprising a photosensitive layer and a conductive substrate, said photosensitive layer being overlaid on said conductive substrate, said conductive substrate having a uniform surface roughness having such that a center average roughness Ra of standard reference length at 0.25 mm, is not more than 0.6 μm, and said uniform surface roughness satisfying the following condition:

$$\frac{T-3}{38} < Ra < \frac{T+12}{55}$$

where Ra is the center average roughness and T is a transmittance at a wavelength of a laser beam approximately in a range of 630 nm to 830 nm exposing said photosensitive layer.

2. An electrophotographic photoreceptor as claimed in claim 1, wherein said center average roughness Ra is approximately within a range between 0.10 μm and 0.45 μm.

3. An electrophotographic photoreceptor as claimed in claim 1, wherein said transmittance T is not more than 18%.

4. A method of forming an electrostatic latent image on an electrophotographic photoreceptor having a photosensitive layer on a conductive substrate, said method comprising the steps of:

forming a surface roughness of said conductive substrate such that a center average roughness Ra of standard reference length at 0.25 mm, is not more than 0.6 μm, and said surface roughness satisfying the following condition:

$$\frac{T-3}{38} < Ra < \frac{T+12}{55}$$

where Ra is the center average roughness and T is a transmittance at a wavelength of light exposing said photosensitive layer;

charging a polarity on a surface of said electrophotographic photoreceptor;

exposing said electrostatic latent image to a laser beam having a wavelength approximately in a range of 630 nm to 830 nm; and developing said electrostatic latent image, wherein said forming step eliminates interference fringe patterns and spots from appearing on said image.

5. An electrophotographic photoreceptor as claimed in claim 1, wherein said substrate having said uniform surface roughness is roughed by a wet honing process.

* * * * *